US010238936B2

(12) United States Patent
Jensen

(10) Patent No.: US 10,238,936 B2
(45) Date of Patent: Mar. 26, 2019

(54) GOLF BALL AND TEE SETTING AND RETRIEVAL DEVICE

(71) Applicant: John J. Jensen, Eugene, OR (US)

(72) Inventor: John J. Jensen, Eugene, OR (US)

( * ) Notice: Subject to any disclaimer, the term of this patent is extended or adjusted under 35 U.S.C. 154(b) by 0 days.

(21) Appl. No.: 15/932,523

(22) Filed: Mar. 8, 2018

(65) Prior Publication Data

US 2018/0369664 A1 Dec. 27, 2018

Related U.S. Application Data

(60) Provisional application No. 62/604,070, filed on Jun. 21, 2017.

(51) Int. Cl.
*A63B 57/00* (2015.01)
*A63B 55/00* (2015.01)

(52) U.S. Cl.
CPC ..... *A63B 57/0037* (2013.01); *A63B 55/408* (2015.10)

(58) Field of Classification Search
CPC .... A63B 57/0037; A63B 55/408; A63B 47/02
See application file for complete search history.

(56) References Cited

U.S. PATENT DOCUMENTS 4,616,826 A * 10/1986 Trefts ..... A63B 57/0037 294/116
4,714,250 A * 12/1987 Henthorn ..... A63B 57/0037 294/19.2
4,819,938 A * 4/1989 Hill ..... A63B 47/02 294/19.2
4,949,961 A * 8/1990 Milano ..... A63B 47/02 294/116
5,330,177 A * 7/1994 Rogge ..... A63B 47/02 294/19.2
5,669,646 A * 9/1997 Fiocca ..... A63B 57/0037 294/24
5,672,121 A * 9/1997 Miller ..... A63B 47/02 294/19.2
5,707,303 A * 1/1998 Berkowitz ..... A45B 3/00 294/19.2
6,254,497 B1 * 7/2001 Brant ..... A63B 47/02 473/386
6,394,515 B1 * 5/2002 Keleher ..... A63B 47/02 294/115

(Continued)

*Primary Examiner* — Steven Wong
(74) *Attorney, Agent, or Firm* — Robert E. Howard

(57) ABSTRACT

A device for setting a golf ball and tee. The device includes an upper handle portion connected to a lower gripper portion by an elongated tubular stem portion, the upper handle portion including a pivotal trigger member. The lower gripper portion includes a pair of jaw members pivotal about a pin member. A cable member is located within the elongated tubular stem portion and communicates the pin and trigger members, allowing the normally open jaw members to be brought together to hold a golf ball and tee upon activation of the trigger member. A stand member is attached to the elongated tubular stem portion adjacent its lower end, and includes a spike member extending downwardly therefrom. A golf ball stop member configured to prevent contact between a golf ball and the upper portions of the jaw members extends between the jaw members.

9 Claims, 4 Drawing Sheets

(56) References Cited

U.S. PATENT DOCUMENTS

| | | | | |
|---|---|---|---|---|
| 2003/0203772 | A1* | 10/2003 | Paine | A63B 57/0037 473/386 |
| 2004/0029653 | A1* | 2/2004 | Whitehill | A63B 57/0037 473/386 |
| 2007/0021239 | A1* | 1/2007 | Gates | A63B 57/0037 473/386 |

* cited by examiner

GOLF BALL AND TEE SETTING AND RETRIEVAL DEVICE

CROSS-REFERENCE TO RELATED APPLICATIONS

This application claims the benefit of U.S. Provisional Application No. 62/604,070, filed Jun. 21, 2017, the entire contents of which are hereby incorporated by reference.

BACKGROUND OF THE INVENTION

The present invention relates to a golf ball and tee setting and retrieval device which allows the user to simultaneously set a golf ball and associated tee into the ground in the tee box for teeing off.

The device of the present invention is also a retrieval device which allows the user to retrieve a ball or tee from the green, bushes, pond area, etc., or a tee from or adjacent to the tee box It can be difficult for elderly golfers or golfers suffering from infirmities affecting their bending motion, to bend over to tee up a golf ball prior to driving from a tee box. Likewise, it can be difficult to retrieve a tee after teeing off, or to retrieve a golf ball from a green after its removal from a hole, or to retrieve a golf ball from the rough. The device of the present invention allows the user to perform these acts without having to bend down Over the years many devices have been proposed for performing these functions, and many such devices have been patented and can be found in U.S. Class 473/133. However, many of these devices are mechanically complicated and difficult to use.

SUMMARY OF THE INVENTION

The present invention relates to a device for setting a golf ball and tee into the ground of a tee box prior to teeing off without the user having to bend over.

The device can also be used to retrieve a golf ball from any location, and to retrieve a tee from the ground in or around a tee box.

The device of the present invention includes an upper handle portion connected to a lower gripper portion by an elongated tubular stem portion.

The upper handle portion includes a fixed handle member, a pivotal trigger member, and a finger hold. The finger hold has a downwardly extending portion configured to allow the finger hold to be draped over the lip of a golf bag when the device is placed within the golf bag for transport.

The lower gripper portion includes first and second pivotal jaw members adapted to receive and firmly grasp a golf ball and tee therein for insertion of the tee into the ground.

The first and second pivotal jaw members have first and second upper lever arm portions, respectively, that are adjacent each other at a movable intersection point. First and second upper lever arm portions have first and second arcuate slots located therein, respectively.

A pin extends through the first and second arcuate slots at the movable intersection point, and is fixed in place.

A cable member is positioned within the elongated tubular stem portion and extends between, and is attached to, the pin and trigger member. A compression spring is located above the pin which, in its uncompressed state, holds the jaw members apart.

As the trigger member is depressed, it pulls the cable upwardly which raises the pin together with the first and second lever arms and contracts the compression spring, thereby bringing the jaw members toward each other and into contact.

A stand member is attached to the elongated tubular stem portion adjacent its lower end. The stand member is substantially L-shaped and includes a substantially horizontal leg and a substantially vertical leg extending downwardly from the horizontal leg. The inner surface of the vertical arm portion facing the gripper portion is configured to support a golf ball between the open jaw members when the device is being held in a substantially horizontal position with the lower gripper portion being slightly higher than the upper handle portion for loading the golf ball and tee into the gripper portion.

A horizontal golf ball stop member extends into the space between the jaw members adjacent the top thereof, and is positioned and configured to prevent a golf ball from moving upwardly into contact with the upper portion of the jaw members during use of the device.

The vertical leg of the stand member has a spike member extending vertically downwardly therefrom past the lower end of he gripper portion. The spike member stabilizes a tee against wobbling during its insertion into the ground during use of the device. The spike member also allows the device to be temporarily stored in an upright position for subsequent retrieval by inserting the spike into the ground.

DESCRIPTION OF PREFERRED EMBODIMENTS

Figure 1:
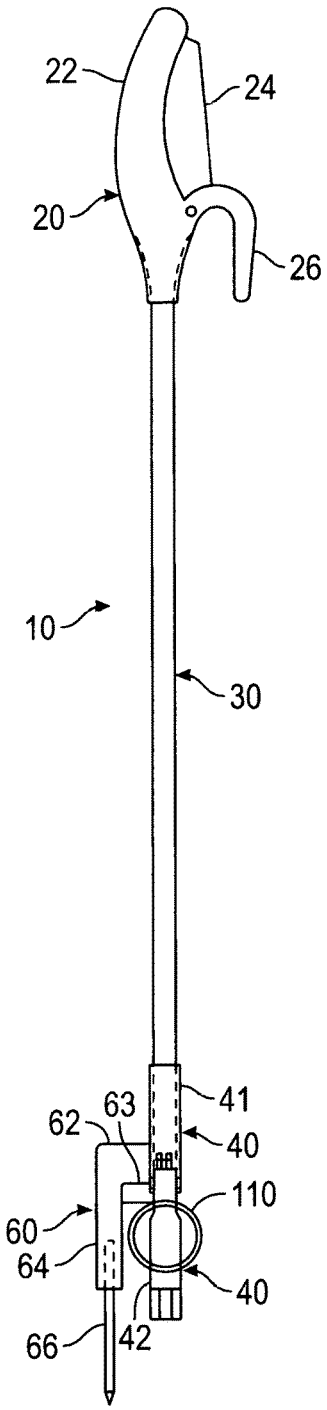
FIG. 1 is a vertical side view of the golf ball and tee setting and retrieval device of the present invention.

The golf ball and tee setting and retrieval device 10 includes an upper portion 20, an elongated tubular stem portion 30, a lower gripper portion 40, and a stand member 60.

Upper handle portion 20 includes a fixed handle member 22, a pivotal trigger member 24, and a finger hold 26. The finger hold 26 has a downwardly extending portion configured to allow the finger hold 26 to be draped over the lip of a golf bag when the device is placed within the golf bag for transport.

Tubular stem portion 30 extends between upper portion 20 and gripper portion 40. Tubular stem portion is hollow and can have any desired cross-section, such as circular or rectangular.

Figure 6:
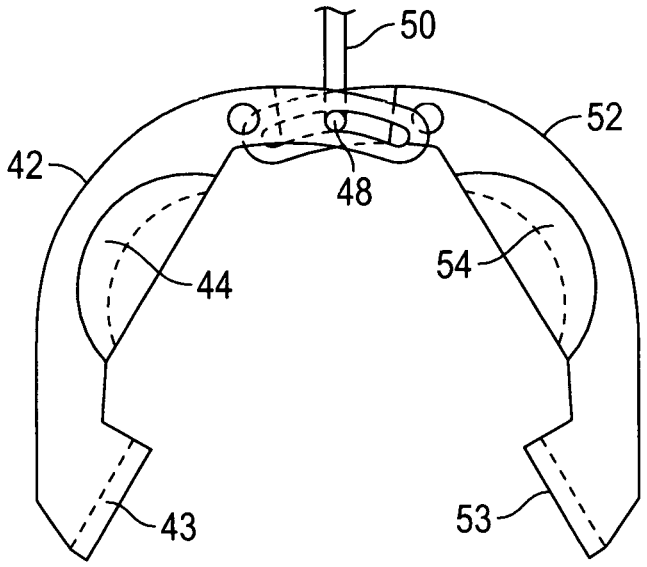
FIG. 6 is an enlarged front view of the gripper portion of the golf ball and tee setting and retrieval device of the present invention, the jaws being shown in the open position.
Figure 7:
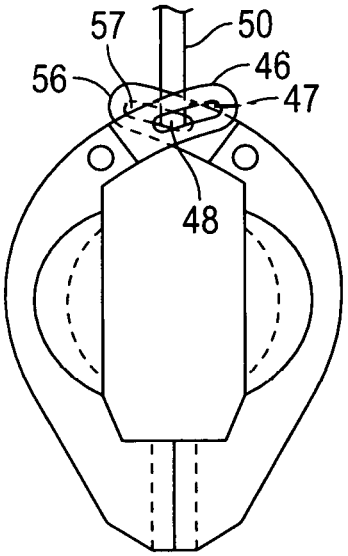
FIG. 7 is an enlarged front view of the gripper portion of the golf ball and tee setting and retrieval device of the present invention, the jaws being shown in the closed position.
Figure 8:
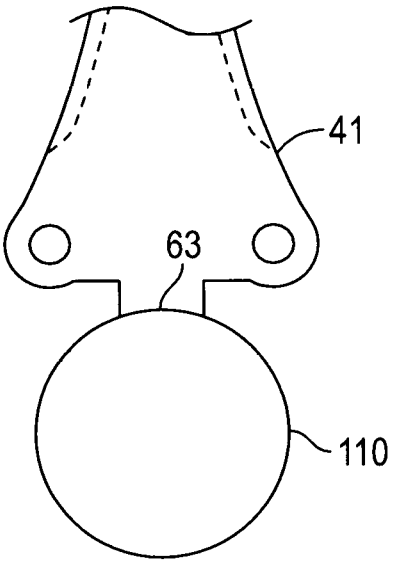
FIG. 8 is an enlarged front view of the pivot mount and golf ball stop member.

Lower gripper portion 40 includes a pivot mount 41, first and second pivotal jaw members 42 and 52, respectively, configured to receive and firmly grasp a golf ball 110 and a tee 112. As best seen in FIGS. 6 and 7, wherein pivot mount 4 has been omitted for sake of clarity, first jaw member 42 has a lower concave hemispherical portion 44 configured to receive about one-half of golf ball 110 therein, and an upper lever arm portion 46 having an arcuate slot 47. Opposing second jaw member 52 has a lower concave hemispherical portion 54 configured to receive about one-half of golf ball 110 therein, and an upper lever arm portion 56 having an arcuate slot 57. First and second lever arms 46 and 56 are adjacent each other at a movable intersection point. A pin 48 extends through slots 47 and 57 at the movable intersection point and is attached to the sides of pivot mount 41.

Figure 10:
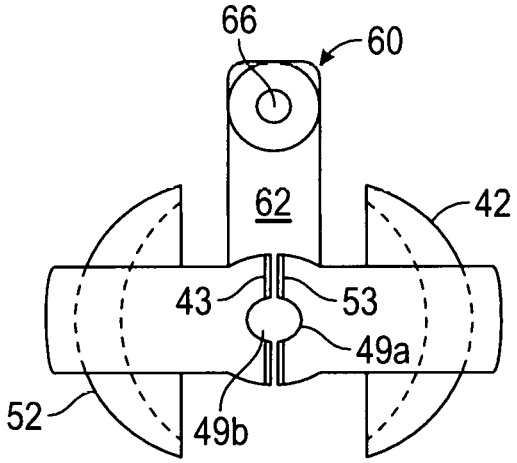
FIG. 10 is an enlarged bottom view of the golf ball and tee setting and retrieval device of the present invention, the jaws being shown in the closed position.

Each of the narrowed and opposing lower rims of jaw members 42 and 52 preferably has an elastomeric material 43 and 53, respectively, attached thereto whose purpose will be discussed below. A tee slot 49*a* and 49*b* is formed in the center of the elastomeric material formed on the narrowed lower rims of jaw members 42 and 52, respectively, for receiving and grasping the stem of tee 112. See FIG. 10.

A taut cable member 50 extends between pin 48 and the inner end of pivotal trigger member 24 and is attached thereto.

Figure 2:
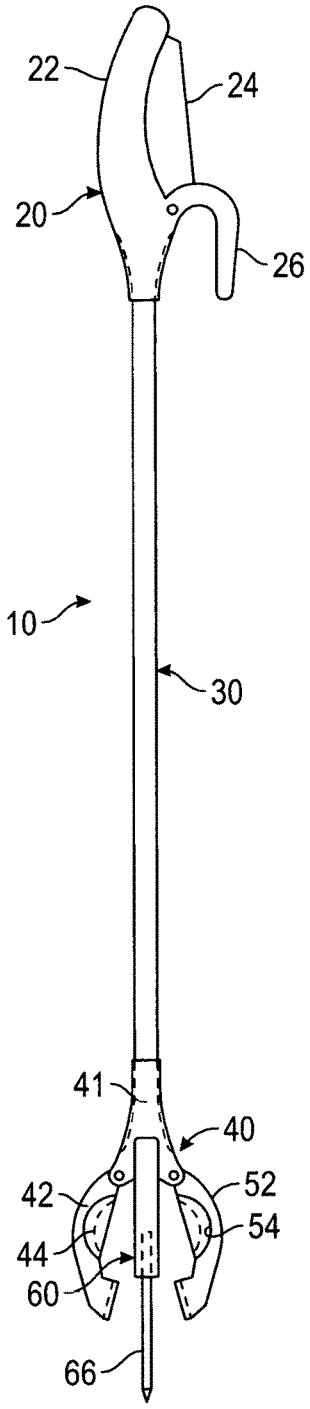
FIG. 2 is a vertical back view of the golf ball and tee setting and retrieval device of the present invention.
Figure 3:
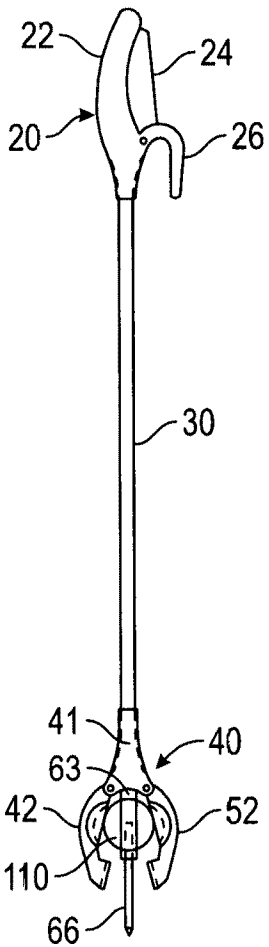
FIG. 3 is a vertical front view of the golf ball and tee setting and retrieval device of the present invention showing a golf ball resting on the stand of the device for loading.

A compression spring (not shown) is positioned around cable 50 and abuts pin 48 at its lower end and abuts a stop member (not shown) located above pin 48. In its uncompressed state the compression spring retains jaw members 42 and 52 in the spread apart position shown in FIGS. 2, 3, and 4. The use of a compression spring and stop member for the purpose just described are well known in the gripper art.

Stand member 60 is attached to pivot mount 41 located at the lower end of tubular stem portion 30. Stand member 60 includes an L-shaped arm having a horizontal arm portion 62 and a vertical, downwardly extending arm portion 64 located adjacent gripper portion 40.

The inner surface of vertical arm portion 64 facing gripper portion 40 is configured and positioned to support a golf ball placed between jaw members 42 and 52 during loading of the golf ball and tee into device 10. See FIG. 3.

Figure 5:
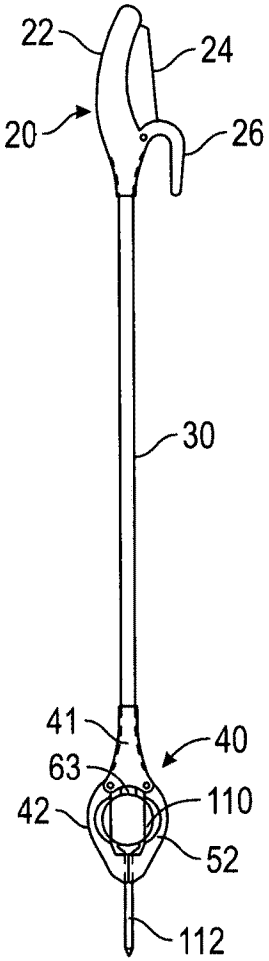
FIG. 5 is a vertical front view of the golf ball and tee setting and retrieval device of the present invention showing the jaws of the device closed against the golf ball and tee, the stand member not shown for sake of clarity.
Figure 4:
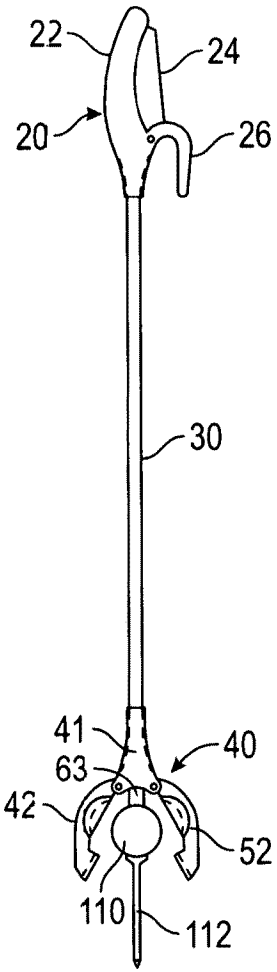
FIG. 4 is a vertical front view of the golf ball and tee setting and retrieval device of the present invention showing a tee placed against the bottom of a golf ball for loading, the stand member not shown for sake of clarity.
Figure 9:
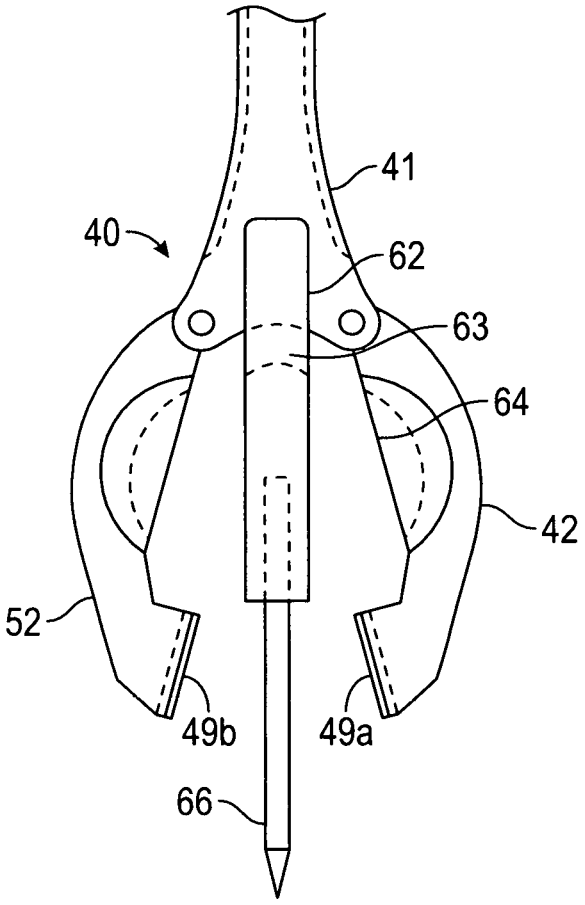
FIG. 9 is an enlarged rear view of the gripper portion of the golf ball and tee setting and retrieval device of the present invention, the jaws being shown in the open position.

As best seen in FIGS. 4, 5, and 9, horizontal golf ball stop member 63 extends downwardly from pivot mount 41 into the space between the upper portions of jaw members 42 and 52 and abuts a golf ball placed between the jaw members. Golf ball stop member 63 prevents a golf ball loaded into device 10 from pushing against the upper portions of jaw members 42 and 52 during use which could push the jaws apart and cause tee 110 to drop out.

A spike member 66 extends vertically downward from the lower end of vertical arm portion 64 to a terminal location below the lower end of gripper portion 40.

In operation as a golf ball and tee setting device, the user would be located in a tee box and needs to place a golf ball 110 on a tee 112 in the ground in order to be able to drive the ball down the fairway. The user would hold device 10 in a substantially horizontal position with the lower gripper portion being slightly higher than the upper handle portion for loading the golf ball and tee into the gripper portion and preventing the golf ball from rolling out. A golf ball 110 would be placed between the open jaw members 42 and 52, its downward side resting on the adjacent hemispherical surface of arm portion 64, and its top abutting golf ball stop member 63. A tee 112 would be positioned with its head in abutment with the bottom of the golf ball and its stem in alignment with tee slots 49*a* and 49*b*. Trigger member 24 would be squeezed to cause the jaw members 42 and 52 to close about the golf ball 110 and tee 112 by virtue of the movement of cable 50 towards upper portion 20 of device 10 and the compression of the compression spring. The user would then rotate device 10 to a substantially vertical position and, with the tee 112 resting on the ground at a selected location, push downwardly to insert the tee 112 into the ground. Spike member 66 is substantially simultaneously inserted into the ground, thereby stabilizing device 10 and stabilizing tee 110 against wobbling during its insertion. Trigger member 24 would then be released to cause jaw members 42 and 52 to open by virtue of the uncompression of the compression spring. Device 10 can then be temporarily stored upright by inserting spike 66 into the ground at a suitable location and the device retrieved after the user has teed off.

In operation as a golf ball retrieval device, the narrowed lower portion of jaw members 42 and 52 of gripper portion 40 having elastomeric material 43 and 53 thereon would be placed around the ball and trigger member 24 squeezed to cause the jaw members 42 and 52 to close about the golf ball by virtue of the movement of cable 50 towards upper portion 20 of device 10 and the compression of the compression spring. The user would then retrieve the ball from jaw members 42 and 52. A tee could be similarly retrieved.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A device for setting a golf ball and tee and retrieving the same comprising:

an upper handle portion connected to a lower gripper portion by an elongated tubular stem portion;

said upper handle portion including a fixed handle member and a pivotal trigger member;

said lower gripper portion including first and second pivotal jaw members configured to receive and grasp a golf ball and tee therein;

said first and second pivotal jaw members having first and second upper lever arm portions, respectively, said first and second upper lever arms being adjacent each other at a movable intersection point, said first and second upper lever arm portions having first and second arcuate slots therein, respectively;

a pin extending through said first and second arcuate slots at said movable intersection point and attached to said lower gripper portion;

a cable member located within said elongated tubular stem portion and communicating said pin and said trigger member; and a stand member attached to said elongated tubular stem portion adjacent its lower end, said stand member being substantially L-shaped and including a substantially horizontal leg and a substantially vertical leg extending downwardly from said horizontal leg adjacent said gripper member, said vertical leg having a spike member extending downwardly from said vertical leg to a terminal location below said gripper portion.

2. The device of claim 1 wherein said first and second pivotal jaw members have first and second concave hemispherical portions, respectively, each of said first and second concave hemispherical portions configured to receive about one-half of a golf ball.

3. The device of claim 1 wherein said vertical leg of said stand member is configured to receive a golf ball thereon and in a location that allows said golf ball to be gripped by said first and second jaw members.

4. The device of claim 1 including a pivot mount is attached to the lower end of said tubular stem portion and said pin extending through said jaw members is attached to said pivot mount.

5. The device of claim 1 including a golf ball stop member extending into the space between the upper portions of said first and second pivotal jaw members and configured and positioned to prevent a golf ball grasped by said jaw members from coming into contact with said upper portions of said jaw members.

6. The device of claim 4 including a golf ball stop member extending downwardly from said pivot mount into the space between the upper portions of said first and second pivotal jaw members and configured and positioned to prevent a golf ball grasped by said jaw members from coming into contact with said upper portions of said jaw members.

7. The device of claim 1 wherein said upper handle portion includes a finger hold.

8. The device of claim 7 wherein said finger hold is configured to allow it to fit over the lip of a golf bag.

9. A device for setting a golf ball and tee and retrieving the same comprising:

an upper handle portion connected to a lower gripper portion by an elongated tubular stem portion having upper and lower ends;

said upper handle portion including a fixed handle member, a pivotal trigger member, and a finger hold;

said lower gripper portion including first and second pivotal jaw members configured to receive and grasp a golf ball and tee therein;

said tubular stem portion including a pivot member attached to said lower end thereof;

said first and second pivotal jaw members having first and second upper lever arm portions, respectively, said first and second upper lever arms being adjacent each other at a movable intersection point, said first and second upper lever arm portions having first and second arcuate slots therein, respectively;

a pin extending through said first and second arcuate slots at said movable intersection point and attached to said pivot mount;

a cable member located within said elongated tubular stem portion and communicating said pin and said trigger member;

a stand member attached to said elongated tubular stem portion adjacent its lower end, said stand member being substantially L-shaped and including a substantially horizontal leg and a substantially vertical leg extending downwardly from said horizontal leg adjacent said gripper member, said vertical leg having a spike member extending downwardly from said vertical leg to a terminal location below said gripper portion; and a golf ball stop member extending downwardly from said pivot mount into the space between the upper portions of said first and second pivotal jaw members and configured and positioned to prevent a golf ball grasped by said jaw members from coming into contact with said upper portions of said jaw members.

* * * * *